United States Patent [19]

Anderson

[11] 4,076,427

[45] Feb. 28, 1978

[54] WRITING INSTRUMENT HAVING A PREDETERMINED GRASP SHAFT CONFIGURATION

[76] Inventor: Charles Roger Anderson, 20 East St., Proctor, Vt. 05765

[21] Appl. No.: 559,918

[22] Filed: Mar. 19, 1975

Related U.S. Application Data

[63] Continuation of Ser. No. 399,389, Sep. 21, 1973, abandoned.

[51] Int. Cl.[2] ..... A46B 5/02

[52] U.S. Cl. ..... 401/6; 401/198

[58] Field of Search ..... 401/6, 7, 40–43, 401/198, 199; 15/443, 444

[56] References Cited

U.S. PATENT DOCUMENTS 3,397,938 8/1968 Juelss ..... 401/198 X

*Primary Examiner*—Stephen C. Pellegrino

*Attorney, Agent, or Firm*—Parmelee, Johnson & Bollinger

[57] ABSTRACT

A writing instrument such as a pen having a nib and a shaft for hand-held use. The shaft is formed with three elongated concave indentations in a generally equilateral triangular configuration with rounded vertices and at least one concave side as seen in cross section in the region normally grasped which form sockets to receive the thumb, index finger and middle finger respectively so as to provide a firm, comfortable and relaxed grasp ensuring complete control of the instrument and virtually eliminating writing tension. The nib is adjustable positionable relative to the shaft axis to provide a nib edge alignment at an angle to the pen's horizontal axis as defined by the three concave indentations, thus ensuring an optimum angle of contact between the nib and a writing surface, regardless of whether the pen is used right or left-handed, for producing attractive pleasing writing. Interchangeable nibs containing their own soluble marking medium in a nib unit may be provided for a shaft which carries solvent to be fed to the nib unit through a dialysis membrane. This pen is advantageous for use by both adults and children and can be used with any of a number of writing systems as taught to children in various schools. It is found that children's hands become relaxed in using this writing instrument and their writing skills advance more rapidly than when using conventional equipment.

9 Claims, 17 Drawing Figures

Fig. 6.
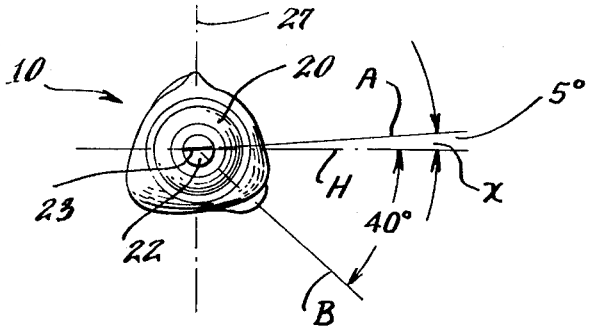
Fig. 7.
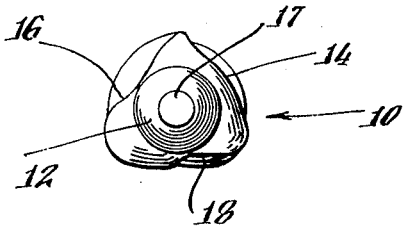
Fig. 8A.
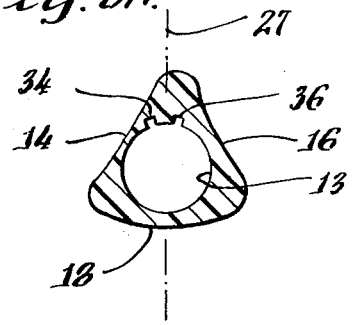
Fig. 8B
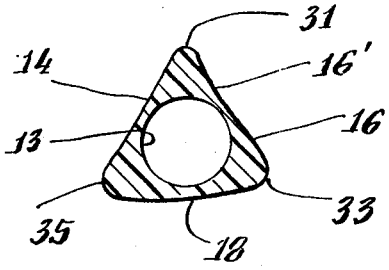
Fig. 8C.
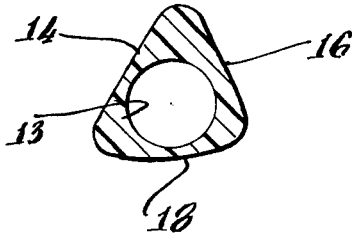
Fig. 8E.
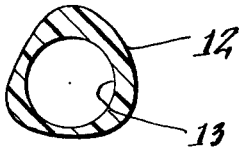
Fig. 8D.
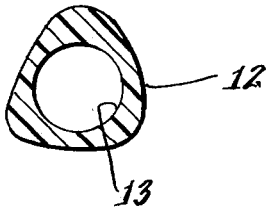
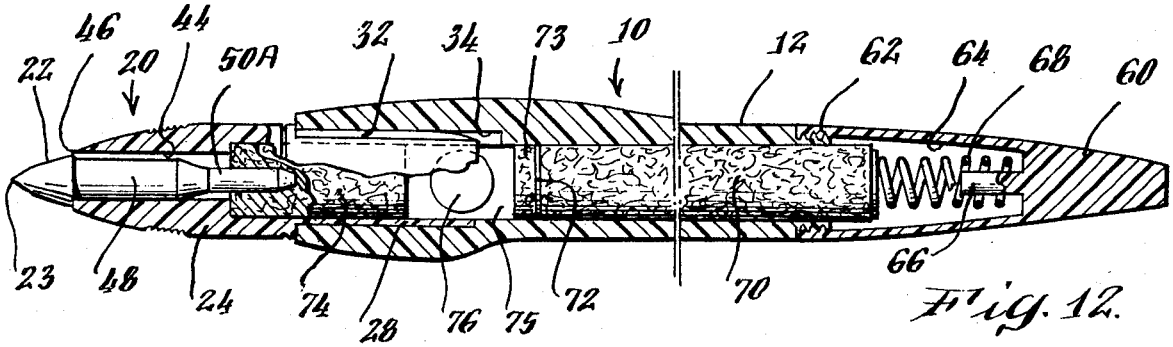
Fig. 12.

WRITING INSTRUMENT HAVING A PREDETERMINED GRASP SHAFT CONFIGURATION

BACKGROUND OF THE INVENTION

This invention relates to writing instruments and particularly to hand-held writing tools having a predetermined grasp shaft configuration for use with the italic alphabet and italic writing systems. By replacing the nib housing unit having a broad-edged writing nib with one having a pointed nib, the writing instrument can also be used advantageously for non-italic alphabets and writing systems. Irrespective of whether an individual is one experienced in the art of calligraphy or a child first learning penmanship, a command of certain fundamental procedures for using the writing instrument is necessary for attractive and legible writing. Included among these are correct positive grip affording complete control of the writing instrument and contact of the writing tip with a writing surface at the correct angle of contact while encouraging the correct writing posture.

Writing instruments, such as pens and the like, available today generally have a shaft shape which, although tapered along the axis, is symmetrical or uniform about its entire periphery. Writing nibs in common use with such instruments, whether they be broad-edged or pointed, have no particular characteristic which will assure that they will be placed in contact with the writing surface at the proper angle. Also, conventional writing instruments have no particular characteristic to assure that the tips of the user's thumb and index finger are positioned at the optimum distance from the writing surface.

The aforementioned shortcomings result in writing instruments frequently being grasped and applied to writing surfaces improperly. A pen shaft which is round, or approximately round, and smooth can slip in the hand when in use or roll on surfaces. Moreover, if the nib is broad-edged, there is no assurance that the pen shaft is being grasped in such a manner that the nib will be applied to the writing surface at an optimum angle nor at an angle which is reproducible from one time of writing use to another.

My research has shown that there is an optimum or correct grasp and position of the thumb, index finger and middle finger for holding and using a writing instrument, and that a number of advantages and improvements flow from the user's achievement of this correct grasp and position, as will be explained.

This invention provides a writing instrument which can be used for all types of writing, formal writing and lettering, italic writing, calligraphy, industrial marking, sketching, and the like. Moreover, the invention positively assures that the user, regardless of whether adult or a 5-year old, will achieve the correct grasp and position of the thumb, index finger, and middle finger with respect to the writing instrument and the writing surface leading to several advantages, as will be discussed below, as shown by actual experimental testing.

SUMMARY OF THE INVENTION

The present invention overcomes the disadvantages associated with prior art writing instruments, particularly, those drawbacks giving rise to improper shaft grip and control and nib contact, by providing a writing instrument shaft shape which permits only the correct and the most comfortable grasp and positioning of fingers and thumb with respect to the writing surface. This is accomplished according to the invention by providing a shaft having three elongated indentations thereon which receive the thumb, index finger and middle finger of the writing hand. These indentations are provided and positioned so that the fingers and thumb are directed thereto and proper grasp of the shaft achieved. Because of the nature of the indentations, it is not possible, except with deliberate unnatural effort, to grasp the writing instrument improperly. As a result, the shaft shape discourages young children first learning penmanship from incorrect and damaging grasp of the writing instrument while at the same time providing experienced writers with the light, positive and relaxed, comfortable grip which allows complete control of the tool. The pen has been used with complete effectiveness and ease of operation of 5-year old children.

Thus, it is an object of the invention to provide a writing instrument shaft having finger-fitting depressions located thereon so as to require that the writing instrument be grasped in accordance with correct hold as established by natural tendency, scientific research and practical usage.

A further object of this invention is the provision of a writing instrument shaft which permits a light, fatigue-free grasp which is firm, comfortable and allows complete control of the instrument with minimal effort.

A further advantage of the writing instrument of the present invention over those previously available is the provision of a writing nib which contacts the writing surface at the proper angle at all times, regardless of whether a pointed or broad-edged tip. This is achieved for a broad-edged nib for italic writing by providing the writing nib in particular angular relationship with respect to the writing instrument shaft horizontal axis and the locations of the indentations thereon. In this manner, such straight-edged nibs will be applied to the paper at the correct angle of contact of 45° since the writing nib is located in predetermined controlled relationship to the instrument shaft and takes into account the manner in which the shaped shaft will be grasped and used. Finding and maintaining this angle of contact is the most difficult discipline of italic writing for the writer to accomplish consistently and is of absolute necessity for the production of consistent legible letter forms.

Thus, it is an additional object of the invention to provide a writing instrument which assures that a broad-edged writing nib will contact the writing surface at the correct 45° angle of contact to make it necessary for the writer only to exercise control over the direction of movement.

The writing instrument of this invention may be used by either right-handed writers or left-handed writers who write with the hand below the writing line since there is provided means for positioning the broad-edged writing nib in predetermined selected rotational relation to the instrument shaft so that the correct grip as well as angle of contact with writing surface is always maintained.

The unique predetermined grasp shaft configuration can be used to advantage with a pointed tip for all kinds of writing and allows convenient comfortable usage by left-handed writers as well as right-handed writers. In other words, it is a universal grasp shaft configuration which can be used with equal ease by left-right-handed persons.

The illustrative writing nib is contained in a nib unit, removably connected to the instrument shaft, which may be arranged to contain the marking medium, such as ink, dyes, color pigment in solid soluble form, or the like. Thus, readily interchangeable nibs and colors may be provided for individual writing or lettering versatility, and for inexpensive replacement, without the need for extra shaped shafts. If desired, the shaft may contain solvent which feeds into the nib unit and dissolves and carries the marking medium to the writing nib for transfer to the writing surface, thus eliminating liquid ink loading, if desired.

A yet further aspect of the illustrative example of the invention described is the provision of a writing instrument having interchangeable marking medium transferring means and writing nibs adjustably positionable in selected relationship to the instrument shaft.

BRIEF DESCRIPTION OF THE DRAWING

The foregoing as well as other objects, aspects and advantages of the invention will become further apparent from a consideration of the description of an illustrative embodiment of the invention shown in the drawing in which:

FIG. 6 is an end view of the writing instrument shown in FIG. 1 illustrating the angle of the writing nib;

FIG. 7 is an end view of the writing instrument shown in FIG. 1 as seen looking at the upper end of the shaft;

FIGS. 8A, 8B, 8C, 8D and 8E are enlarged cross-sectional views of the grasp portion of the shaft of the writing instrument taken on the parallel planes 8A, 8B, 8C, 8D and 8E perpendicular to the longitudinal axis of the writing instrument to show the relative shapes of the three elongated indentations. In the actual size writing instrument these parallel cross-sectional planes are approximately one-quarter of an inch apart;

FIG. 12 is a longitudinal sectional view of the embodiment of the invention in which a solvent cartridge is pressed against a dialysis membrane with a soluble color medium being contained in a compartment in the replaceable nib housing unit.

DESCRIPTION OF THE PREFERRED EMBODIMENTS

Figures 1, 2, 3, 4, 5:
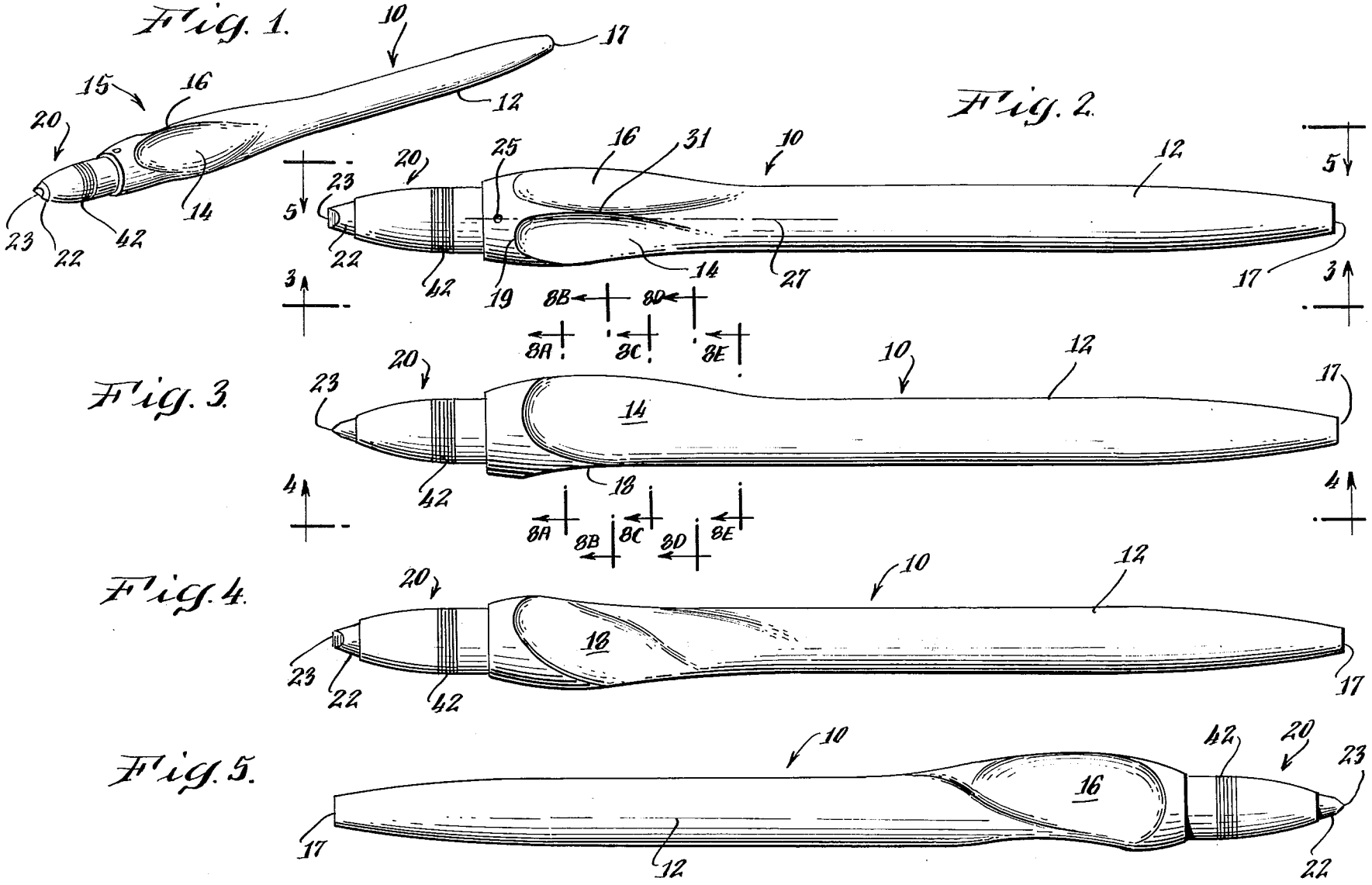
FIG. 1 is a perspective view of a writing instrument embodying the present invention.
FIG. 2 is an enlarged top plan view of the writing instrument of FIG. 1.
FIG. 3 is an enlarged side elevational view as seen looking at the thumb-side (for right-handed persons) of the writing instrument of FIG. 2, i.e., looking in the direction 3—3 toward FIG. 2.
FIG. 4 is an enlarged bottom plan view of the writing instrument as seen looking in the direction 4—4 toward FIG. 3.
FIG. 5 is an enlarged side elevational view of the writing instrument as seen looking toward the index-finger-side (for right-handed persons), i.e., as seen looking in the direction 5—5 toward FIG. 2.

Referring to FIG. 1, there is illustrated a writing instrument 10, a pen having a shaft 12 and marking medium transfer means, shown generally at 20, including a writing nib 22 with a chisel tip 23 held by a nib housing unit 24. The writing instrument shaft 12 is hollow with a bore 13 and is of dimension and weight so that it may be held in the hand of a writer. There is a region generally indicated at 15 called the grasping region where the shaft 12 should be grasped by the two fingers and thumb for a correct writing instrument hold for the vast majority of persons; that is, the hold which provides the most comfortable grasp which is firm and in control of the instrument but nevertheless comfortable and fatigue-free. This grasping region 15 extends for a distance along the shaft 12 of approximately one and one-eighth of an inch, and its configuration will be explained in greater detail below.

The lower boundary of this grasping region 15 is located between five-eighths of an inch and one and five-eighths of an inch from the writing tip 23. The preferred arrangement is to have the lower boundary of this grasping region between seven-eighths and one and three-eighths of an inch from the writing tip 23. In the illustrative example shown, the lower boundary of the grasping region is positioned approximately 1⅛th of an inch from the writing tip.

In this grasping region 15, there are provided three elongated concave indentations 14, 16 and 18 for reception of the writer's thumb, index finger and middle finger respectively. The concavity of the indentation is better understood by reference to FIGS. 2 through 8, and particularly to FIGS. 8A, 8B, 8C, 8D and 8E, which are a sequence of cross sections taken perpendicular to the longitudinal axis of the shaft 12 and shown enlarged. These cross sections are taken on parallel planes, as shown in FIG. 3, equidistantly spaced along the axis, being spaced ¼, ½, ¾, 1 inch and 1¼ inch, respectively, from the lower boundary 19 of the grasping region 15.

For convenience of the user, the writing instrument 10 may be provided with an identifying index mark 25 (FIG. 2), such as a dimple, which in use, is located near the tips of the thumb and index finger. This index mark facilitates the user's picking up the instrument in the proper initial orientation.

However, even in the absence of such an index mark 25, the grasping region is so naturally and comfortably held by the user, that the user will shift the instrument into the proper position immediately upon feeling it with his thumb and two fingers. (It is to be understood that with the three indentations 14, 16 and 18, there are only three possible positions to hold the instrument, and one of them feels natural and comfortable.)

The vertical longitudinal plane 27 (FIG. 2) passing through this index mark 25 is also indicated in the cross-sectional views 8A through 8E to show the relative and changing shapes of the concave indentations 14, 16 and 18 at various distances from the lower boundary 19 of the grasping region 15.

It is seen that a cross section (FIG. 8B) on a plane perpendicular to the longitudinal axis of the writing instrument shows a generally equilateral triangular configuration with rounded convex vertices and at least one concave side. Looking from the upper end 17 of the instrument toward the marking medium transfer means 20, the elongated concave indentation 14 for the thumb of a right-handed person is skewed slightly away from the longitudinal axis in the helical direction of a "right hand", or clockwise advancing, screw thread. Similarly, the elongated concave indentation 18 for the middle finger is skewed slightly away from the longitudinal axis in the helical direction of a "right hand", or clockwise advancing, screw thread. The elongated concave indentation 16 for the index finger (of a right-handed person) extends generally longitudinally along the shaft. It may be skewed slightly in the clockwise direction to fit and receive the thumb side (left side) of the tip of the index finger of a right-handed person, if desired.

Referring to the cross-sectional views, it is seen that the concave indentations 14, 16 and 18 are arranged adjacent one another about the periphery of the shaft 12. The shape of the indentations is such that the cross-sectional view shown in FIG. 8B, which is the section where the perimeters of the indentations 14 and 16, respectively, come in closest proximity to another on the shaft periphery, appears as a stylized equilateral triangle having rounded vertices 31, 33 and 35, and a slightly concave region 16. The indentations may be identical and symmetrically arranged about the periphery of the shaft but preferably these indentations each has its individual configuration as shown. The indentation 16 for the index finger (of a right-handed person) is of slightly shorter axial length in proportion to the other two indentations to effect the most natural and comfortable, as well as proper, grasp.

The unique form of the shaft 12 in the region where the grasp is normally effected assures a correct hold as established by natural tendency, scientific research and practical usage. This hold allows greater control over the instrument than normally is obtainable with minimal effort. The grasp achieved is light, fatigue-free, firm and comfortable. The shaft grasp shape encourages the proper placement of thumb and fingers and, therefore, discourages inexperienced writers, such as young children, from an incorrect and damaging whole hand or fist grasp, with the advantageous result that the writing instrument having a shaft grasp configuration according to this invention can be used with complete effectiveness and ease of operation by 5-year old children. Although one standard writing instrument size is conveniently usable, the dimesions may be proportioned to suit the user, whether a small child or an adult.

FIG. 6 shows a writing tip view of the instrument 10 and particularly illustrates the manner in which writing nib 22 is positioned at a slight angle "X" to the horizontal axis H of the writing instrument, so as to provide correct placement of the nib 22 on a writing surface, as described hereinafter. The nib 22 illustrated is a broad edge nib finding particular use in italic writing, caligraphy or lettering or drawing. The chisel edge 23 of the nib 22 is positioned at a small angle "X" which is between 2° and 10°, and preferably is 5°, measured counterclockwise from a horizontal plane "H" normal to the vertical plane 27. This vertical plane 27 passes through the shaft axis and through the vertex 31. The counterclockwise angle X is measured looking at the chisel edge 23 with the upper end 17 of the instrument held away from the user, as seen enlarged in FIG. 6.

This angular displacement "X" assures that the writing edge 23 of the nib 22 will contact a writing surface at the correct angle of contact which has been determined to be very nearly 45°. The angle of 45° is the correct angle, in my view, for producing italic writing. Also, the fact that the shaft grasp configuration with angle "X" automatically assures the correct angle of tip-to-surface contact, thereby encourages the most correct and relaxed writing posture in the user.

The angle "X" shown is that for right-handed writers and those left-handed writers who normally write with the left hand above the writing line; that is, the hook position. For a left-handed writer who writes with the hand below the writing line, the nib writing edge 23 should be angularly displaced 40° to 50°, and preferably 45° clockwise from the position "X", namely, should assume an angle "Y" measured clockwise from the plane H. The preferred value for angle Y is 40°. In that case, the nib 22 is produced with a 45° canted edge to accommodate such left-handed writers.

The finding and maintaining of the angle of contact with the writing surface is the most difficult discipline of italic writing for the writer to accomplish consistently and is of absolute necessity for the production of good legible attractive letter forms. The cooperation of the shaft 12 grasp shape and the angle of the nib edge 23 of the writing instrument 10 assures that this function is automatically performed by the writer, making it necessary for the writer only to exercise control over the direction of movement.

Figure 9:
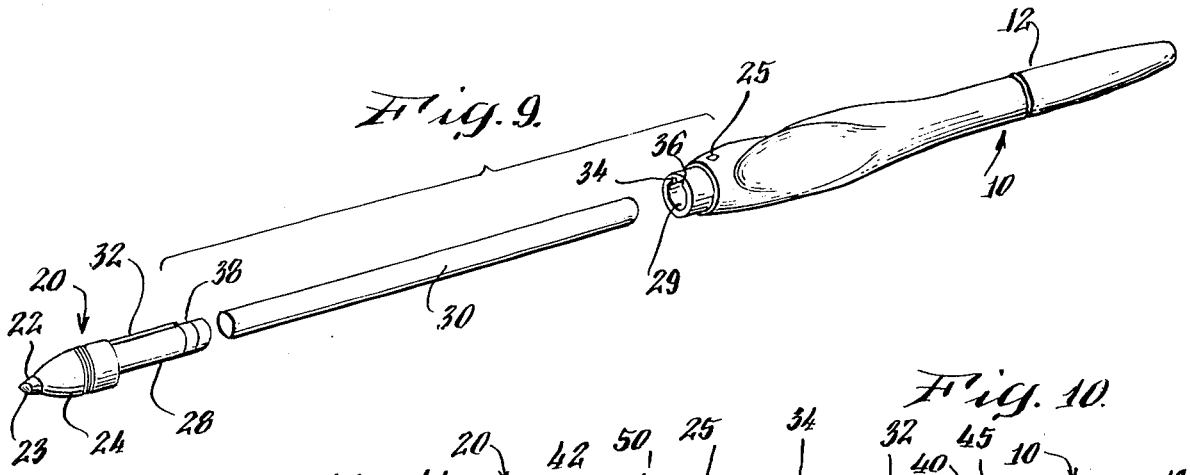
FIG. 9 is an exploded perspective view of the writing instrument shown in FIG. 1 illustrating the manner in which the shaft and replaceable nib unit may be detachably joined together, with an ink cartridge insertable into the hollow shaft.

FIG. 9 is an exploded perspective view showing the manner in which the shaft 12 and writing medium transfer means, 20 are removably joined together to make a complete writing instrument. Illustrated is a means for removably joining the two parts 12 and 20 in two selected predetermined positions to permit positioning the edge 23 of the nib 22 at desired angle for right or left-handed writers. Also, detachment of the nib housing 24 permits removal and replacement of the ink-containing cartridge 30. In addition, the nib housing 24 may be removed for replacement or exchange of the nib housing for one having a different nib size or shape.

Figure 10:
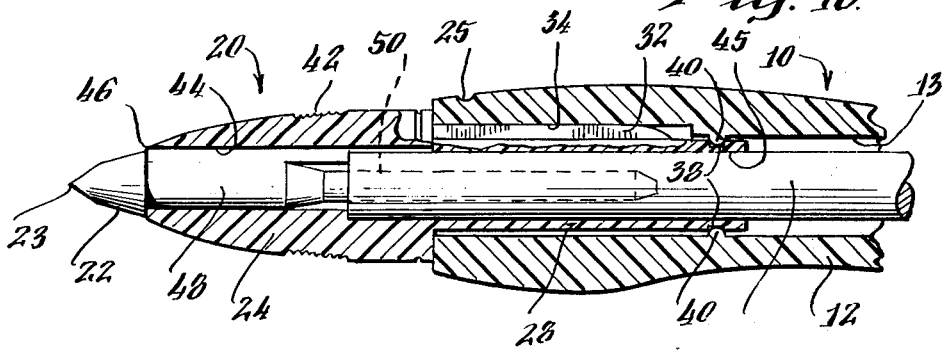
FIG. 10 is an enlarged partial longitudinal sectional view, taken along the axis of the writing instrument shown in FIG. 1 illustrating further details of the replaceable nib unit and cartridge.

The marking medium transfer means 20 is composed of nib 22 and a nib housing unit 24, as seen also in FIG. 10. An upper cylindrical portion, shown generally at 28, of nib housing unit 24, is dimensioned so as to be received in the socket opening 29 of hollow shaft 12 in a male-female relationship. Molded as an integral part of the cylindrical portion 28 is a longitudinally extending placement rib or key 32. Positioning of the nib edge 23 at the proper angle to the shaft is assured by the placement key slots 34 and 36 which receive placement key 32. These keyway slots 34 and 36 are shown 45° apart around the axis of the shaft 12. Thus the nib housing unit 24 can enter the shaft 12 only with the key 32 aligned with one or the other of the keyway slots 34 and 36 in the two predetermined positions illustrated in FIG. 9. Placement of the key 32 in the slot 34 results in position "A" which provides the 2° to 10° (preferably 5°) counterclockwise angular displacement "X" for right-handed writers. Placement of the placement key 32 in the slot 36 results in position "B" which provides the degree clockwise angle "Y" for left-handed writers.

Referring again to FIGS. 9 and 10, it is seen that the cylindrical portion 28 contains an encircling detent groove 38 to be engaged by one or more detents 40 protruding into the bore 13 of the shaft 12, when the cylindrical portion 28 is fully inserted. There may be a band of knurling 42 around the nib housing unit 24 to provide a grip for inserting or removing the nib housing unit.

There is an air vent channel 44 extending along the axial bore of the nib housing unit 24. This vent channel has its entrance 46 positioned adjacent to the nib 22 and near its tip 23. The nib itself has a lower portion 48 of diameter comparable with the protruding portion of the nib 22 and has an upper portion 50 of smaller diameter.

The shaft 12 may be manufactured of any durable moldable material such as plastic and can be formed by injection molding and other plastic molding techniques. Similarly, the nib housing unit 24 can be of molded plastic while the writing nib 22 may be composed of an absorptive nylon fibrous, felt or porous material or similar durable porous wicking material which is capable of depositing ink by the wick principle. This material is selected to provide instant starting without slippage and smooth glide without tearing of the writing surface. The writing nib can be formed from flat stock with a double chisel edge and manufactured in a number of straight edge writing sizes and various dimensions including from 3/16 inch down to 1/32 inch. A similar broad edge nib may be produced with a 45° canted edge to accommodate left-handed writers who write with the hand below the writing line. A conventional pointed nib may be used where italic writing is not involved but when nevertheless the unique shaft advantages are desired. Thus, the various nib sizes and types will be available to enable the user to meet a wide variety of writing or lettering needs as he wishes. This also provides easy and inexpensive replacement for worn or damaged nibs.

The upper cylindrical portion 28 of the nib housing unit has an enlarged bore 45 which may be sufficiently large to receive the lower end of the ink-containing cartridge 30. Thus, the cartridge 30 can directly engage the upper portion 50 of the nib. If desired, this upper nib portion 50 can be inserted into the lower end of the cartridge 30 to provide for free flow of ink from the cartridge into the nib.

Alternatively, the upper portion 50 of the nib can be surrounded by an absorbent porous filler material having good wicking action for conveying ink from the cartridge 30 into the nib portion 50.

The air vent 44 communicates with the enlarged bore 45 within the upper portion 28 of the nib housing unit. Thus, as ink is withdrawn from the cartridge 30, air is admitted to take its place. The ink-containing cartridge 30 may be formed by an absorbent porous material saturated with ink.

Figure 11:
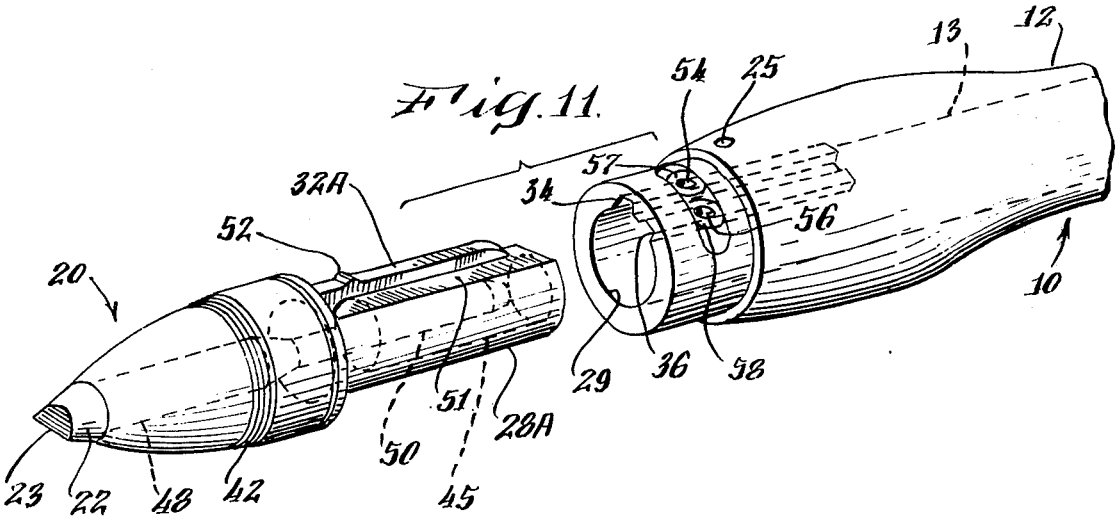
FIG. 11 is an enlarged exploded perspective view illustrating an alternative embodiment of the invention in which different detent means are used to hold the replaceable nib housing unit attached to the shaft.
Figure 11A:
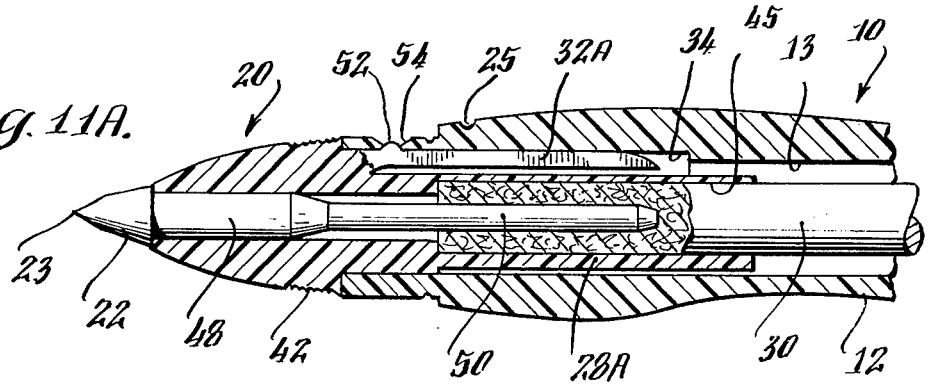
FIG. 11A is an enlarged partial sectional view illustrating further details of the replaceable nib and detent means.

FIGS. 11 and 11A show a modified embodiment of the invention in which a resilient placement key 32A is formed as an integral part of the nib housing unit and serves also as detent means to hold the nib in place. This placement key 32A is undercut at 51 on the cylindrical portion 28A to provide flexibility, and it has a detent hump 52 which can snap into detent holes 57 and 58 in the writing instrument shaft 12. The shaft 12 may be provided with two external recesses 54 and 56 around the holes 54 and 56, respectively, to provide an area where the detent 52 may be depressed by a fingernail or the like to release the placement key 32A to separate the shaft 12 and nib housing unit 24. The hole 54 is aligned with the keyway slot 34 and similarly the hole 56 is aligned with the other keyway slot 36.

With reference to FIG. 12, there is shown another embodiment of the positionable and replaceable fluid marking medium transfer means 20. The enlarged bore of the nib portion 28 forms a chamber 75 which communicates with the upper portion 50A of the nib 22. This chamber or compartment 75 may receive any recognizable marking medium 76 such as soluble pigmented material, concentrated ink, magnetic ink and the like, in the form of paste, soluble solid color plug or other usable form. The upper end of the chamber 75 is sealed with a dialysis membrane 72. The dialysis membrane 72 is formed of semi-permeable membrane material, e.g. cellophane, selected so as to prevent passage of the material in the chamber 75 out through the membrane 72 while permitting passage into the chamber 75 of a suitable solvent and carrier for the marking medium contained therein. The solvent and carrier for passage into the chamber 75 are stored in the bore 13 of the writing instrument shaft 12 as a solvent-containing cartridge 70.

In order to press the lower end of the carrier-containing cartridge 70 firmly against the dialysis membrane 72, there is a screw-on cap 60 at the upper end of the shaft. This cap screwed onto the shaft by means of threads at 62. Within this cap is a recess 64 having an axial retainer pin 66 extending down from the upper end of the cap. A spring 68 seats around this pin 66 and presses down against the cartridge 70 to press it against the membrane. The cartridge 70 is formed of porous absorbent material saturated with a solvent or carrier for the marking medium 76.

A porous absorbent filler material 73 is shown positioned between the membrane 72 and the marking medium 76. Additional porous absorbent material 74 is shown surrounding the upper portion 50A of the nib 22 and engaging the marking medium 76. This upper nib portion 50A may be shorter than the nib portion 50 in FIG. 10 to provide clearance for the pellet 76 of marking medium.

The advantage of this writing instrument embodiment shown in FIG. 12 is that the nib housing unit can be removed from the shaft 12 and replaced by another one containing a different color of marking medium. Thus, a single shaft 12 with an assortment of replaceable nib housing units can be used to provide many different colors.

In operation, the dialysis membrane 72 allows only a one-way flow of solvent into the chamber 75 to dissolve the marking medium 76, such as a color plug of soluble crystalloid pigment and carry it into the writing nib 22. The dialysis membrane is permanently attached to the nib housing unit 24 and prevents a flow of color particles into the solvent-containing barrel 13, avoiding contamination thereof. By providing such a reverse dialysis membrane, the nib units of different colors may be interchanged at will without danger of color contamination of the solvent barrel chamber and without mess. The dialysis membrane may be readily selected from those types available and may be based on selective diffusion of either molecules or particles of a certain size with the result that the color material is not passed while the solvent is. When a nib is not in use on the shaft, it may be capped on its end with a suitable closure to keep the membrane free from contact with the air. The dimensions of the cap can duplicate the shape and outside dimensions of the writing instrument shaft enabling it to be stored on the top end 17 of the shaft and protected against loss or misplacement when the writing instrument is in use. The light-weight material used assures that the additional weight shift does not appreciably affect the writing instrument's balance.

It is to be kept in mind with respect to FIG. 12 that the advantageous aspect is the interchangeability of the marking medium transfer means 20, so that the desired nib writing edge angle may be obtained and maintained when the writing instrument is in use. In addition, interchangeability provides selection of the appropriate nib, as well as color desired without the need for having to purchase complete units. As a result, the cost is kept down, and a shaft may be provided which suits the individual in terms of weight balance and has a wide selection of interchangeable marking medium transfer means. The details illustrated in FIG. 12 have been found to be those desired for obtaining the results of interchangeability and writing edge angle positioning. However, other known methods of removably joining two parts may be used. By providing a solvent reservoir within the writing instrument shaft, the writing instrument may be used with marking mediums of all types without worry of corrosion or damage to the writing shaft.

I claim:

1. In a hand-held writing instrument having transfer means with a writing tip for transferring a marking medium to a surface in recognizable form and having a shaft for holding said transfer means with said writing tip at one end of said shaft and being of overall dimension and weight to permit grasping by the thumb, index finger and middle finger of a hand, said shaft being operatively connected to the transfer means, the invention comprising said shaft having a longitudinal axis and a circular cross section over the major portion of its length concentric about said axis, said shaft extending generally symmetrically straight along its axis, said marking medium transfer means having a longitudinal axis aligned with and concentric with the axis of the shaft and with said tip being concentrically located with respect to the shaft axis, said shaft having a grasping region extending upwardly along the shaft from a lower boundary, the lower boundary of said grasping region being located between seven-eighths of an inch and one and three-eighths of an inch from the writing tip, said grasping region having therein three axially elongated indentations, each of said indentations commencing at said lower boundary and extending upwardly longitudinally along the shaft from said lower boundary for receiving the thumb, index finger and middle finger, respectively, of a right-handed person, said three indentations being positioned about the periphery of the shaft, the two indentations for receiving the thumb and index finger respectively each being of an elongated tear-drop shape which is enlarged and rounded near said lower boundary and tapering upwardly to merge with the circular cross section of the shaft, said three indentations being generally symmetrically arranged one to another about the shaft axis such that a cross section through the shaft, taken perpendicular to the shaft axis at the location where the perimeters of the indentations for the thumb and the index finger of a right-handed person come in closest proximity one to another on the shaft periphery, appears as a generally equilateral triangle having three sides of approximately equal size and three rounded vertices, said indentation for receiving the index finger of a right-handed person having a concavity for receiving the thumb side of the tip of the index finger as seen in said cross section, and being of slightly shorter axial length in proportion to the other two indentations, thereby to assure that the tips of the user's thumb and index finger are positioned at the optimum distance from the writing surface and to enable the grasping region to be held by a comfortable and relaxed grasp for reducing writing tension while ensuring complete control over the writing instrument.

2. In a writing instrument having transfer means with a writing tip for transferring a marking medium to a surface in recognizable form and having a shaft for holding said transfer means, the invention as claimed in claim 1 in which said elongated indentation for receiving the thumb of a right-handed person and said elongated indentation for receiving the middle finger of a right-handed person are each skewed away from the longitudinal axis of said shaft in the helical direction of a clockwise advancing screw thread.

3. In a hand-held writing instrument having transfer means with a writing nib for transferring a marking medium to a writing surface in recognizable form and having a shaft for holding said transfer means and being of overall dimension and weight to permit grasping by the thumb, index finger and middle finger of a hand, said shaft being operatively connected to the transfer means, the invention comprising said shaft having a longitudinal axis and a circular cross section over the major portion of its length concentric about said axis, said shaft extending generally symmetrically straight along its axis, said marking medium transfer means having a longitudinal axis aligned with and concentric with the axis of the shaft and with said tip being concentrically located with respect to the shaft axis, said nib being broad and having a straight edge for use in italic writing, said shaft having a grasping region extending upwardly along the shaft from a lower boundary, said grasping region having therein three axially elongated indentations, each of said indentations commencing at said lower boundary and extending upwardly longitudinally along the shaft from said lower boundary for receiving the thumb, index finger and middle finger, respectively, of a right-handed person, said three indentations being positioned about the periphery of the shaft for defining a cross section through the shaft taken perpendicular to the longitudinal axis of the shaft at the location where the perimeters of the indentations for receiving the thumb and the index finger of a right-handed person come in closest proximity one to another on the shaft periphery having a stylized equilateral triangle shape with three sides and three rounded vertices, and said straight edge of the nib being positioned so that a first plane through said edge forms a nib angle "X" in the range from 2° to 10° counterclockwise as seen looking in an axial direction toward the nib end of the writing instrument relative to a horizontal plane "H" which is normal to a plane through the shaft axis and through the location where the perimeters of the indentations for receiving the thumb and index finger of a right-handed person come in closest proximity for causing said straight edge to contact the writing surface at the predetermined desired angle of contact of very nearly 45° for producing consistent letter forms in italic writing by right-handed persons and by left-handed persons who normally write above the writing line in the hook position.

4. In a hand-held writing instrument having transfer means with a writing nib for transferring a marking medium to a writing surface in recognizable form and having a shaft for holding said transfer means, the invention as claimed in claim 3 in which said nib angle "X" is preferably five degrees measured counterclockwise from said second plane "H" as seen looking in an axial direction toward the nib end of the writing instrument.

5. In a hand-held writing instrument having transfer means with a writing nib for transferring a marking medium to a writing surface in recognizable form and having a shaft for holding said transfer means, the invention as claimed in claim 3 in which said transfer means includes a nib housing unit removably mounted on the shaft, and placement key means on the shaft and nib housing unit which are inter-engageable in two alternative positions, one of said positions placing the nib edge at said counterclockwise angle "X", and the second of said positions placing the nib edge at an angle "Y" which is located 40° to 50° (preferably 45°) clockwise from the angle "X" for accommodating left-handed persons who write below the writing line.

6. An improved hand-held writing instrument comprising a shaft of overall dimension and weight to permit grasping by fingers of a hand, the shaft being formed with a grasping region in the area normally grasped by the fingers with three elongated indentations formed adjacent one another about the periphery of the shaft, two of the indentations being similar and formed adjacent to one another for receiving the thumb and the index finger of a right-handed user, the third indentation being formed in relation to the other two and for receiving the middle finger, such that a cross section through the shaft, taken at the point where the perimeters of the indentations for the thumb and the index finger of a right-handed user come in closest proximity one to another on the shaft periphery, appears as a stylized equilateral triangle having three rounded vertices, a transfer means having a writing nib for transferring a marking medium to a writing surface in recognizable form, means for removably connecting said transfer means and writing nib to said shaft with said nib being axially aligned with the longitudinal axis of the shaft, said transfer means including a nib housing unit for holding said writing nib, said housing unit having a bore therein defining a first chamber within the nib housing unit for containing marking medium, one end of said chamber being in communication with the writing nib for conducting the marking medium to the writing nib for transfer through said nib to the writing surface, the other end of said first chamber being sealed by a dialysis membrane capable of permitting passage of a predetermined solvent for the marking medium therethrough into said first chamber but being incapable of permitting passage of the marking medium out of said chamber through the membrane, the shaft having an open end for removably receiving the nib housing for connection therewith, said shaft also having a bore defining a second chamber extending from said open end for receiving said solvent located within the shaft for communication through the dialysis membrane with the marking medium in said first chamber located in the nib housing unit when the nib housing unit is connected to said open end of the shaft.

7. An improved hand-held writing instrument comprising a shaft of overall dimension and weight to permit grasping by fingers of a hand, the shaft being formed with a grasping region in the area normally grasped by the fingers with three elongated indentations formed adjacent one another about the periphery of the shaft, two of the indentations being similar and formed adjacent to one another for receiving the thumb and the index finger of a right-hand user, the third indentation being formed in relation to the other two and for receiving the middle finger, such that a cross section through the shaft, taken at the point where the perimeters of the indentations for the thumb and the index finger of a right-handed user come in closest proximity one to another on the shaft periphery, appears as a stylized equilateral triangle having three rounded vertices and at least one slightly concave inward side for receiving the thumb side of the tip of the index finger of a right-handed user, a transfer means having a writing nib with a chisel edge for transferring a marking medium to a writing surface in recognizable form, said transfer means and writing nib being axially aligned with the longitudinal axis of the shaft and being removably connected to the shaft, keying means on said transfer means and on said shaft, said keying means being inter-engageable between said transfer means and said shaft for controllably positioning said transfer means with respect to said shaft in more than one predetermined angular position in rotational relation with the shaft axis, said writing nib being straight-edged and said transfer means being connected to the shaft in such a position that a plane through the writing nib edge forms a nib edge angle "X" relative to a horizontal plane "H" normal to a plane through the shaft axis and through the corner of the triangle where the perimeters of the indentations for receiving the thumb and the index finger of a right-handed user are in closest proximity, to enable the writing edge to contact the writing surface at a predetermined desired angle to contact, thereby to produce italic writing by right-handed users and by left-handed users who normally write above the writing line in the hook position.

8. The improved hand-held writing instrument as claimed in claim 7, wherein the magnitude of the nib edge angle "X" is five degrees measured counterclockwise from said horizontal plane "H" when viewing the instrument axis from the nib end, for causing the straight edge of the nib to contact a writing surface at the predetermined desired angle of 45°.

9. The improved hand-held writing instrument as claimed in claim 8, wherein the magnitude of the nib edge angle "X" is 40° measured clockwise from said horizontal plane "H" when viewing the instrument axis from the nib end, and wherein the straight edge of the nib is canted at 45°, for causing said straight edge to contact the writing surface at the predetermined desired angle of 45°, thereby to produce consistent letter forms in italic writing by lef-handed users who normally write with the hand below the writing line.

* * * * *